US009039313B2

(12) United States Patent
Tsunoda

(10) Patent No.: US 9,039,313 B2
(45) Date of Patent: May 26, 2015

(54) IMAGE FORMING DEVICE WITH CUTTER AND DOOR LOCKING MECHANISM

(71) Applicant: Akira Tsunoda, Hachioji (JP)

(72) Inventor: Akira Tsunoda, Hachioji (JP)

(73) Assignee: KONICA MINOLTA, INC. (JP)

( * ) Notice: Subject to any disclaimer, the term of this patent is extended or adjusted under 35 U.S.C. 154(b) by 27 days.

(21) Appl. No.: 13/855,151

(22) Filed: Apr. 2, 2013

(65) Prior Publication Data

US 2013/0259558 A1 Oct. 3, 2013

(30) Foreign Application Priority Data

Apr. 2, 2012 (JP) ..... 2012-083449

(51) Int. Cl.
*B41J 11/70* (2006.01)
*B26D 7/22* (2006.01)
*B26D 7/00* (2006.01)

(52) U.S. Cl.
CPC . *B26D 7/22* (2013.01); *B41J 11/70* (2013.01); *B26D 7/00* (2013.01); *B26D 2007/005* (2013.01)

(58) Field of Classification Search
CPC ..... B41J 11/70; B26D 7/22
USPC ..... 270/30.09, 30.08, 21.1, 52.17; 400/621; 83/397, 397.1; 412/16
See application file for complete search history.

(56) References Cited

U.S. PATENT DOCUMENTS

| | | | | |
|---|---|---|---|---|
| 4,561,271 | A * | 12/1985 | Scharboneau | 70/399 |
| 2007/0003354 | A1 * | 1/2007 | Tamura et al. | 400/621 |
| 2009/0219375 | A1 * | 9/2009 | Trauer et al. | 347/197 |
| 2012/0020717 | A1 * | 1/2012 | Nakashima | 400/621 |

FOREIGN PATENT DOCUMENTS

| | | | |
|---|---|---|---|
| JP | 5-265275 | A | 10/1993 |
| JP | 7281575 | A | 10/1995 |

OTHER PUBLICATIONS

Notification of Reason(s) of Refusal for patent application No. 2012-083449, mailed on Apr. 22, 2014. English translation attached.
Notification of Reasons for Refusal for Japanese Priority Application No. 2012-083449; Mailing date: Aug. 19, 2014; with English translation.

* cited by examiner

*Primary Examiner* — Daniel J Colilla
(74) *Attorney, Agent, or Firm* — Cantor Colburn LLP

(57) ABSTRACT

A sheet processing device includes a cutter including a movable unit moving toward or away from a predetermined position and cutting a sheet held in the predetermined position, a door provided to a housing having an opening, the door opening and closing the opening for an operation for the cutter. The sheet processing device further includes the housing holding the cutter, a locking member locking and unlocking the door closing the opening and a locking mechanism mechanically connecting the movable unit to the locking member and causing the locking member to lock or unlock the door depending on a position of the movable unit relative to the predetermined position.

7 Claims, 16 Drawing Sheets

IMAGE FORMING DEVICE WITH CUTTER AND DOOR LOCKING MECHANISM

BACKGROUND OF THE INVENTION

1. Field of the Invention

The present invention relates to a sheet processing device and an image forming system.

2. Description of Related Art

A known sheet processing device performs processes such as cutting of a sheet on which an image is formed by an image forming device. Such a sheet processing device thus has a cutter blade to cut sheets.

The sheet processing device also has an opening allowing a mechanic to access the inside of the device, for example, to fix sheet jam in the device. Free access to the inside of the device creates a risk that the user is exposed to the cutter blade and other components in the device. For this reason, the sheet processing device disclosed in Japanese Patent Publication No. H5-265275 has a door for the opening and a locking mechanism to lock the door under a predetermined condition.

A conventional locking mechanism like that in Japanese Patent Publication No. H5-265275, however, locks the door by electric operation of electric components. The mechanism inevitably requires the cost of the electric components and has a risk of unlocking the door in the event of a failure in the electric components.

Methods of preventing the access of the user to the inside of the sheet processing device without the locking mechanism include locating, for example, the cutter blade such that the user cannot be exposed to the cutter blade by the access from the door, and providing a protector within a path from the door to the cutter blade such that the user cannot be exposed to the cutter blade. Both methods, however, prevent the access of the mechanic to the inside of the device, impairing the maintenance efficiency of the device.

SUMMARY OF THE INVENTION

It is an object of the present invention to solve the above problem. That is to provide a sheet processing device or an image forming system which has a simple structure to lock the door.

In order to realize at least one of the above object, a sheet processing device reflecting one aspect of the present invention includes a cutter including a movable unit which moves toward or away from a predetermined position and cuts a sheet held at the predetermined position, a door provided to a housing having an opening, the door opening and closing the opening for an operation for the cutter, the housing holding the cutter, a locking member which locks and unlocks the door closing the opening and a locking mechanism which mechanically connects the movable unit to the locking member and causes the locking member to lock or unlock the door depending on a position of the movable unit relative to the predetermined position.

Preferably, the locking mechanism causes the locking member to lock the door if a distance from the movable unit to the predetermined position is a predetermined value or greater and to unlock the door if the distance from the movable unit to the predetermined position is below the predetermined value.

Preferably, the movable unit includes a holder including two pinch members facing each other, the holder moving at least one of the pinch members toward or away from the predetermined position to pinch and hold a sheet between the pinch members.

Preferably, wherein the movable unit includes a cutter blade which moves toward or away from the sheet held in the predetermined position by the holder and cuts the sheet.

Preferably, the sheet processing device further includes a detecting unit which detects sheet jam in the sheet processing device and a controlling unit which drives the movable unit to release the door from the locking member in response to detection of sheet jam by the detecting unit.

Preferably, the sheet processing device further includes an unlocking member to release the door from the locking member by an operation from an exterior of the sheet processing device.

BRIEF DESCRIPTION OF THE DRAWINGS

The present invention will become more fully understood from the detailed description given hereinbelow and the appended drawings which are given byway of illustration only, and thus are not intended as a definition of the limits of the present invention, and wherein.

DESCRIPTION OF THE PREFERRED EMBODIMENTS

An image forming system 1 in one embodiment of the present invention will now be described with reference to the attached drawings.

Figure 1:
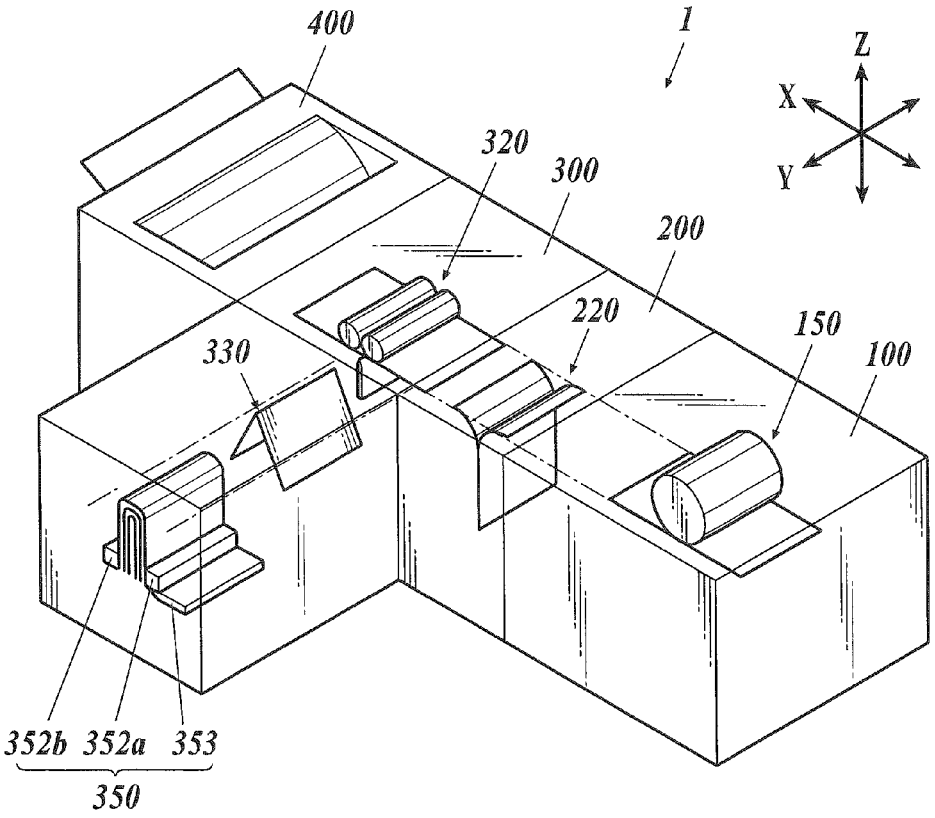
FIG. 1 is a schematic view of an overall image forming system.

FIG. 1 is a schematic view of the overall image forming system 1. The image forming system 1 includes an image forming device 100, a creasing device 200, a sheet processing device 300, and a side stitching device 400.

Note that in the following description the Z-direction indicates the perpendicular direction, the X-direction indicates the direction in which the image forming device 100, the creasing device 200, the sheet processing device 300, and the side stitching device 400 in FIG. 1 are connected to each other, and the Y-direction is orthogonal to the X- and Z-directions. The image forming device 100 forms an image on a sheet. The image forming device 100 includes, for example, a carriage unit pulling out a sheet stocked as recording media from the sheet tray and then carrying it; a developing unit applying the toner based on an image data to a first transfer component, e.g., a transfer roller; a first transfer unit transferring the toner image from the first transfer component onto a second transfer component, e.g., a transfer drum 150; a second transfer unit transferring the toner image from the second transfer component onto the sheet carried by the carriage unit; a fixing unit fixing the transferred toner image to the sheet; and a discharging unit discharging the resulting sheet. With these units, the image forming device 100 forms an image on a sheet.

The image forming device 100 passes the discharged sheet with an image printed thereon to the creasing device 200. The creasing device 200 applies a crease on the sheet and cuts the sheet.

The creasing device 200 includes a carriage unit carrying a sheet, an alignment unit stopping the sheet at a predetermined position for alignment, and a creasing unit (creaser) applying a crease on the sheet after the alignment.

The creasing device 200 passes the sheet provided with a crease to the sheet processing device 300. The creasing device 200 may pass a sheet from the image forming device 100 to the sheet processing device 300 without processing the sheet.

The sheet processing device 300 folds each sheet in two (a center folding step), overlays to stitch the folded sheets (a saddle stitching step), and cuts the stitched sheets (a cutting step).

The sheet processing device 300 includes, for example, a folding unit 320 folding a sheet along a predetermined line in the Y-direction of the sheet; a saddling unit 330 overlaying multiple sheets folded by the folding unit 320; a saddle stitching unit, not shown in the drawing, stitching the sheets overlaid by the saddling unit 330 along the line; a cutter 350 trimming the edges of the sheets such that the edges are parallel to the folds; a carriage unit 340 carrying the sheets between the saddling unit 330 and the cutter 350; a sheet discharging unit discharging the sheets trimmed by the cutter 350. The sheet processing device 300 may pass the sheets from the creasing device 200 to the side stitching device 400 without a part of or the entirety of the processes on the sheets.

The side stitching device 400, for example, side-stitches the sheets. The side stitching device 400 includes, for example, a stapling unit stapling the sheets fed from the sheet processing device 300; a page-edge cutter trimming the edges of the stapled sheets such that the edges are parallel to the spine; and a discharging unit discharging the sheets trimmed by the series of devices. The side stitching device 400 may discharge the sheets fed from the sheet processing device 300 without a part of or the entirety of the processes on the sheets.

The sheet processing device 300 will now be described in detail.

Figure 2:
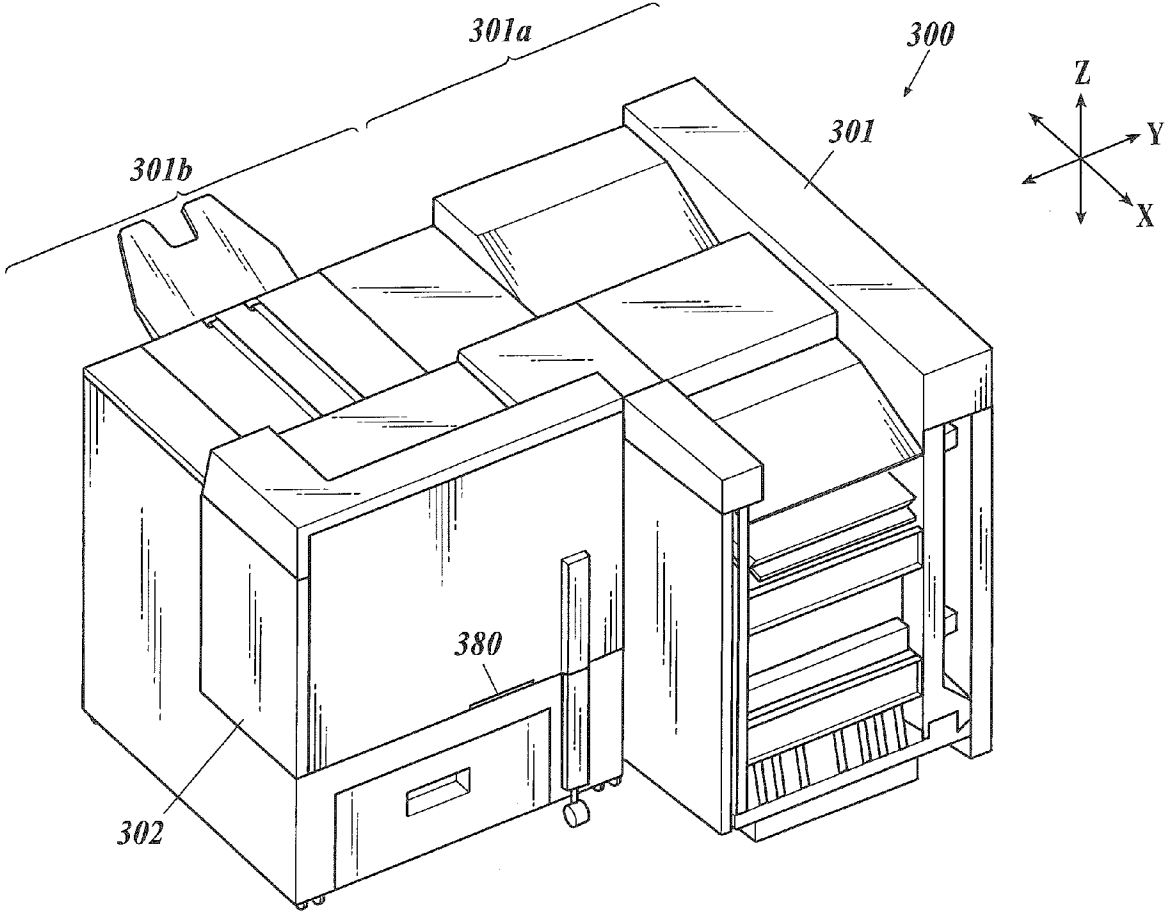
FIG. 2 is a schematic view of the sheet processing device.
Figure 3:
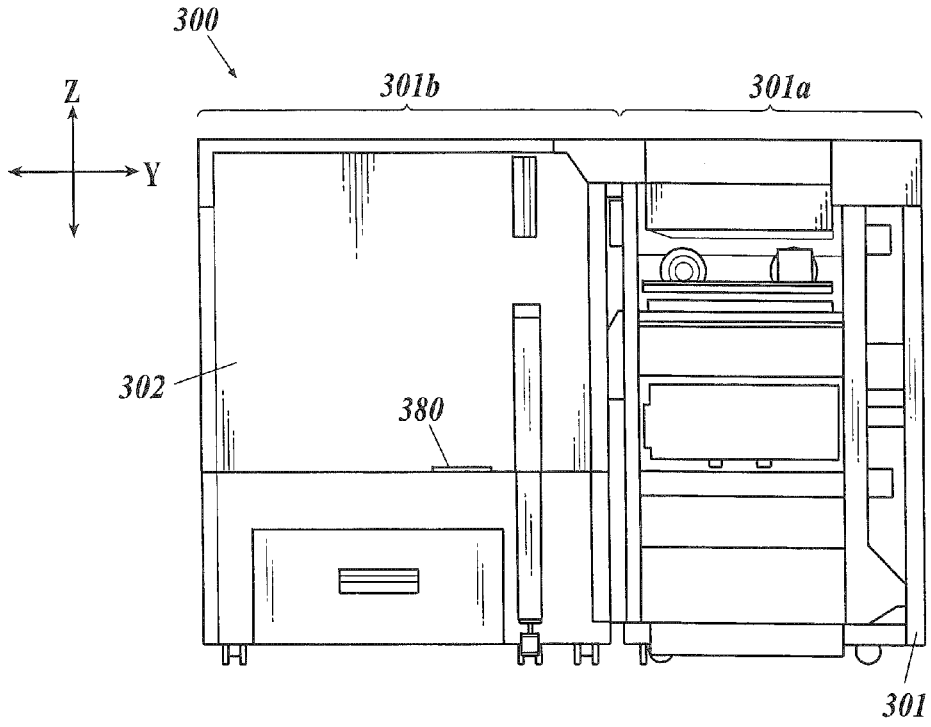
FIG. 3 is a front view of the sheet processing device.

FIG. 2 is a schematic view of the sheet processing device 300. FIG. 3 is a front view of the sheet processing device 300.

The sheet processing device 300 includes a housing 301 containing the cutter 350 and other components, and a door 302 for an opening 300*a* (see FIG. 4) that enables an operator to maintain the cutter 350 and other components in the housing 301.

Specifically, the housing 301 includes a chassis and an outer covering which contain a sheet passing unit 301*a* for the sheet processing device 300 serving as a transfer path between the creasing device 200 and the side stitching device 400 and including the folding unit 320; and a processing unit 301*b* adjoining the sheet passing unit 301*a* in the Y-direction and including the saddling unit 330, the cutter 350, and other units.

The sheets passing through the sheet passing unit 301*a* in the housing 301 are cut in the following manner. The sheets fed from the sheet passing unit 301*a* are overlaid by the saddling unit 330, carried in the Y-direction to the cutter 350 by the carriage unit 340, and then cut by the cutter 350.

Figure 4:
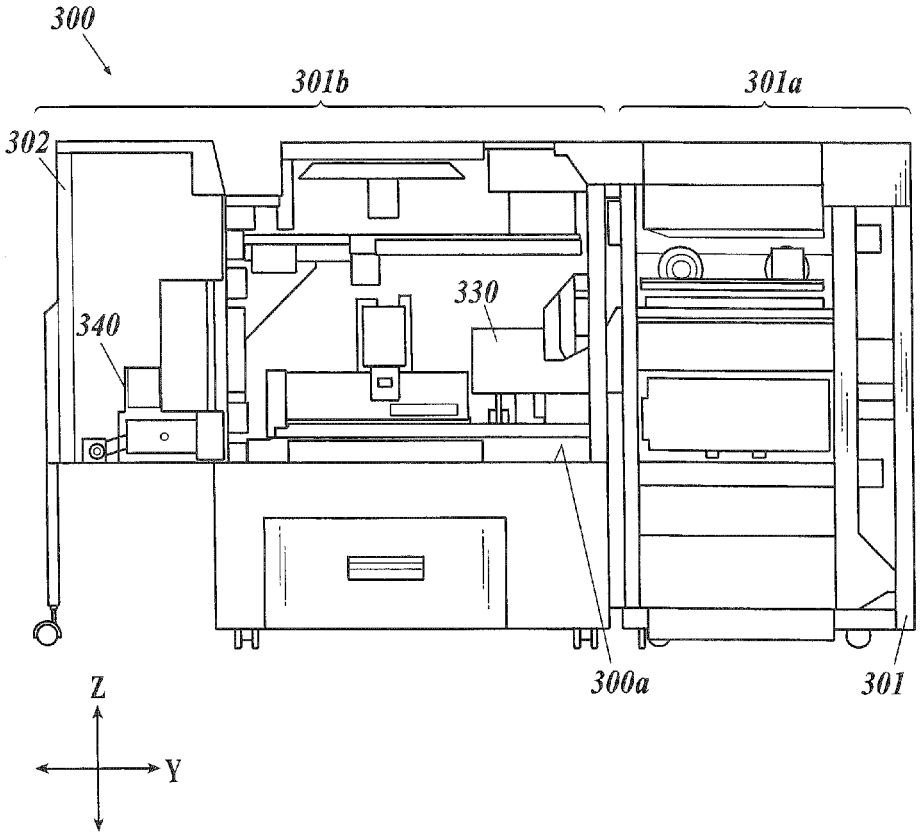
FIG. 4 is a diagram illustrating the sheet processing device with its door opened.

FIG. 4 is a diagram illustrating the sheet processing device 300 with the door 302 opened. The door 302 is operable to open or close the opening 300*a* in the processing unit 301*b*, and thus permits and forbids the user and any other person to perform maintenance on the cutter 350 through the opening 300*a*. Specifically, the door 302 serves as a part of the outer covering to cover the cutter 350 in the processing unit 301*b*, and opens and closes by rotating about a shaft in the processing unit 301*b* extending in a predetermined direction (e.g., the Z-direction).

As shown in FIG. 4, the carriage unit 340 is provided behind the door 302. The carriage unit 340 carries saddle-bound sheets to the cutter 350 along the Z-direction, with the both edges of the fold fixed.

Figure 5:
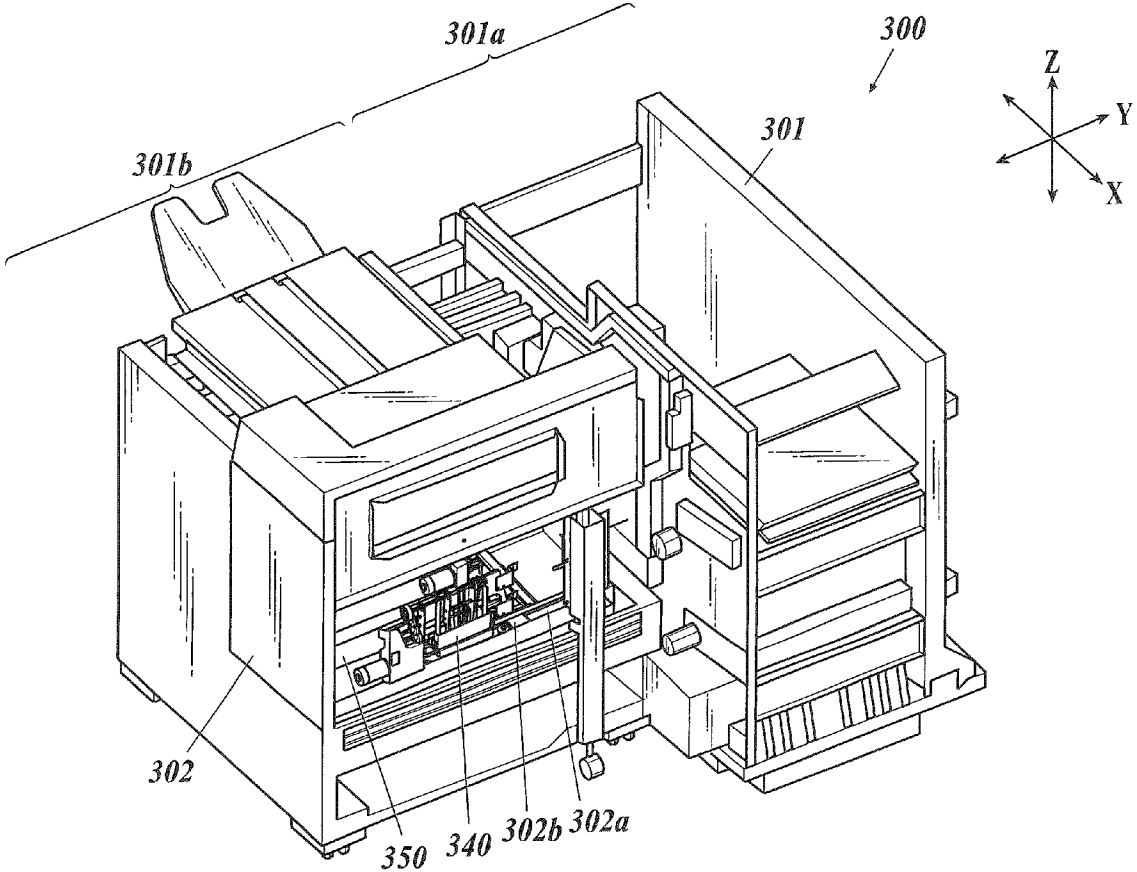
FIG. 5 is a schematic view of the inside of the sheet processing device with its door closed, the view ignoring the outer covering of the door.

FIG. 5 is a schematic view of the inside of the sheet processing device 300 with the door 302 closed, where the outer covering of the door 302 is not depicted.

The door 302 shown in FIGS. 2 and 5 covers the opening 300*a*. The door 302 includes an engaging member 302*a* extending in the Y-direction of the closed door 302 behind the outer covering of the door 302.

The sheet processing device 300 includes a locking member 360 (see FIG. 6, for example) that locks and unlocks the door 302 covering the opening 300*a*. The locking member 360 can enter or exit an engaging hole 302*b* provided to the engaging member 302*a*.

Figure 6:
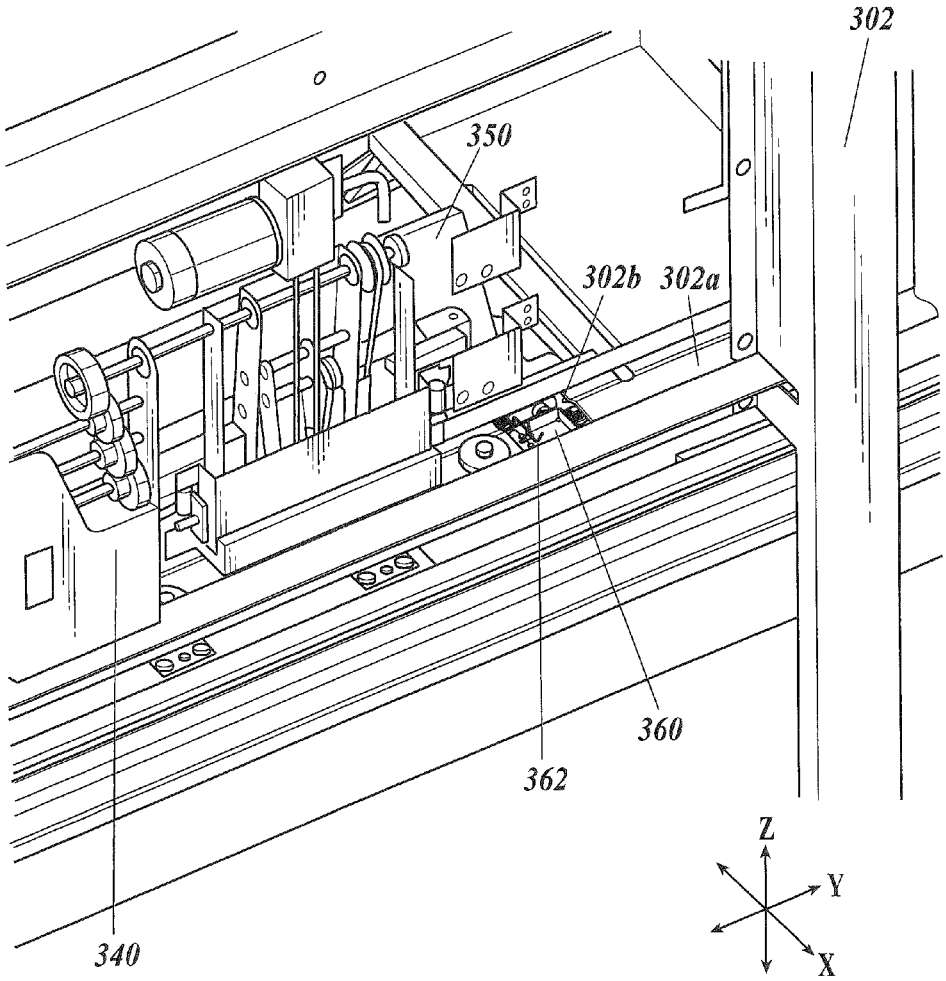
FIG. 6 is a detail view of the locking member in FIG. 5 and the periphery thereof.

FIG. 6 is a detail view of the locking member 360 in FIG. 5 and the periphery. The locking member 360 is provided in the processing unit 301*b* and, as shown in FIG. 6, is located on the inner side of the engaging hole 302*b* of the engaging member 302*a* on the X-Y plane. The locking member 360 is driven by a locking mechanism 370 in cooperation with the cutter 350, and locks and unlocks the closed door 302 for the sheet processing device 300.

The locking member 360 and a structure to operate the locking member 360 will now be described in detail.

Figure 7:
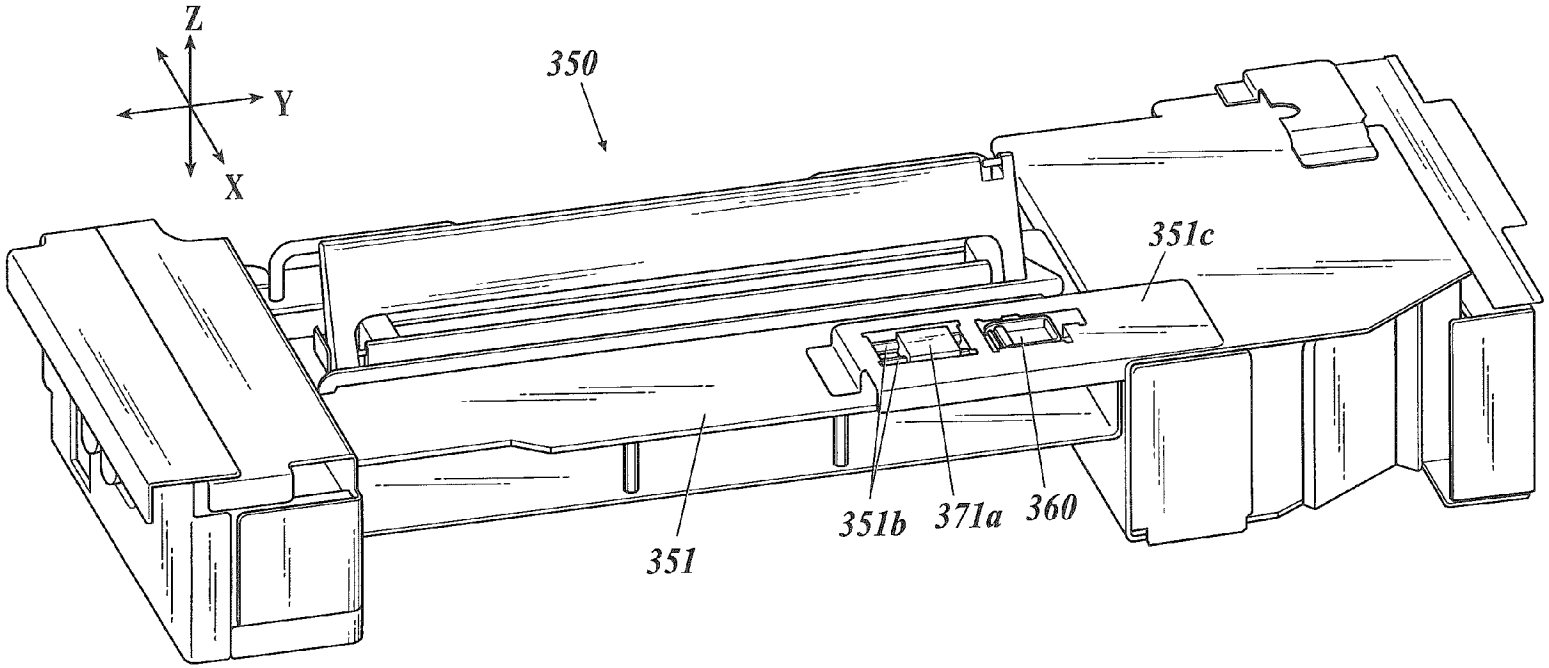
FIG. 7 is a schematic view of a cutter and the locking member.

FIG. 7 is an oblique view of the cutter 350 and the locking member 360.

Figure 8:
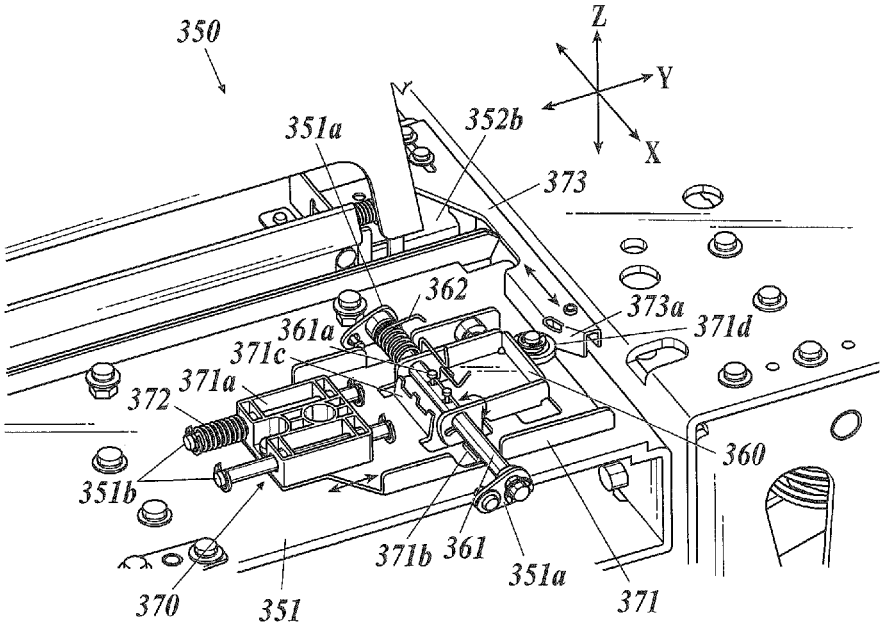
FIG. 8 is a schematic view of the locking member and a locking mechanism.

FIG. 8 is an oblique view of the locking member 360 and the locking mechanism 370.

As shown in FIG. 7, the locking member 360 is disposed on a base 351 of the cutter 350. Specifically, as shown in FIG. 8, the locking member 360 includes a shaft 361 extending in the X-direction. The shaft 361 is supported by bearings 351*a* fixed to the base 351 of the cutter 350 and thus is rotatable. The locking member 360 is rotatable about the shaft 361 supported by the bearings 351*a* on the base 351 of the cutter 350.

In FIG. 8 and other drawings, the locking member 360 is a hollow square box without upper side, and the shaft 361 passes through one of the two sides in the X-direction of the box. Such an embodiment is however just one example and not indispensable. The locking member 360 may have any shape that can enter or exit the engaging hole 302*b*. In the following description of the components of the locking member 360, a second end refers to the end opposite to, in the Y-direction, a first end through which the shaft 361 passes.

The locking member 360 is biased by a biasing member 362.

As shown in FIG. 8, the biasing member 362 is a torsion coil spring at one end of the shaft 361, and pushes down the locking member 360, which is rotatable about the shaft, against the base 351 of the cutter 350 to bias the locking member 360. In FIGS. 6 to 8, the locking member 360 has a rotation angle resulting from the pressure by the biasing member 362 pushing the locking member 360 against the base 351 of the cutter 350.

Figure 9:
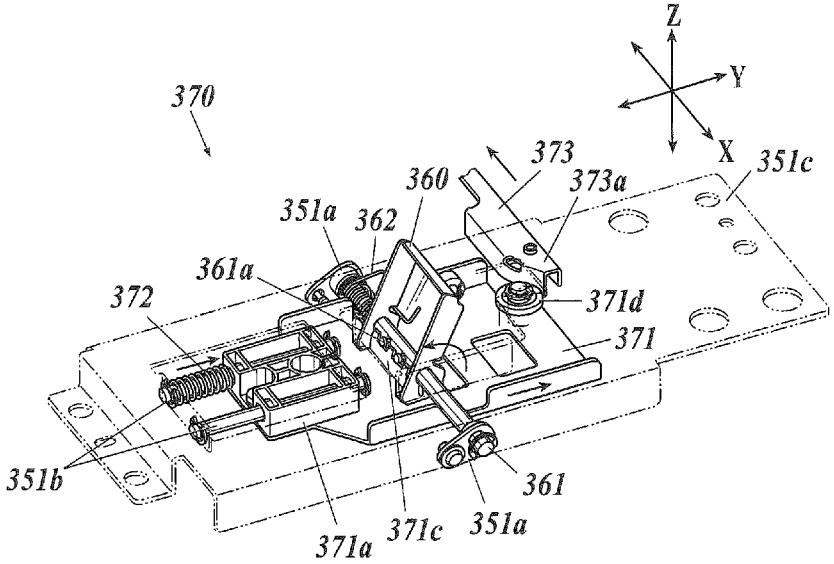
FIG. 9 illustrates a second end of the locking member rotating so as to stand up from the housing of the cutter.

FIG. 9 illustrates the second end of the rotating locking member 360 standing up from the base 351 of the cutter 350.

The locking member 360 rotates with the motion of the cutter 350 by the locking mechanism 370. Specifically, as shown in FIG. 9, the locking member 360 rotates about the shaft 361 at the first end, thereby pushing up the second end from the base 351 of the cutter 350.

The rotation of the locking member 360 by the locking mechanism 370 will now be described in detail. The locking mechanism 370 includes a movable unit 371 movable along the base 351 of the cutter 350 in the Y-direction; a biasing member 372 imparting a pressure to the movable unit 371 in the Y-direction toward one side; a transmission member 373 moving the movable unit 371 in response to the motion of the cutter 350, in the direction opposite to the direction of the pressure by the biasing member 372.

A first side hereinafter refers to the side toward which the biasing member 372 gives a pressure to the movable unit 371 in the Y-direction (the right side in FIG. 9). The opposite side is referred to as a second side.

The movable unit 371 includes a guide 371*a* having a through hole extending in the Y-direction. Guide rails 351*b* passes through the inside of the guide 371*a*, the guide rails 351*b* each having a stick shape, extending in the Y-direction, and having both ends supported by a cover 351*c*, the both ends of which are fixed to the base 351 of the cutter 350. The guide 371*a* supports the movable unit 371 such that the movable unit 371 can move along the base 351 in the Y-direction. The movable unit 371 further includes a contact member 371*b* and an engaging member 371*c*. When the movable unit 371 moves in the Y-direction toward a first side, the contact member 371*b* comes into contact with the shaft 361 of the locking member 360 to push up the second end of the locking member 360 from the base 351 of the cutter 350. The engaging member 371*c* determines the standing angle of the locking member 360, in combination with a pin 361*a* in the shaft 361. The details will be described later. The biasing member 372 is a coil spring at the end of the guide rail 351*b* on the second side in the Y-direction, and pushes the guide 371*a* toward the first side while being in contact with the end of the guide 371*a* on the second side, thereby biasing the movable unit 371.

The transmission member 373 is fixed to the movable member 352*b* of the cutter 350, is disposed between the movable member 352*b* and the movable unit 371, and extends in the X-direction. The transmission member 373 moves in the X-direction in response to the motion of the cutter 350. The transmission member 373 includes a sliding portion 373*a* at one end adjacent to the movable unit 371. As shown in FIG. 9, the sliding portion 373*a* has a face that tilts at a predetermined angle to the X-Z plane. The face is designed to slide on an end 371*d* of the movable unit 371 on the first side. The tilt makes the transmission member 373 taper toward the end in the Y-direction. The transmission member 373 moves the movable unit 371 in the direction opposite to the direction of the pressure by the biasing member 372 in response to the motion of the cutter 350, using the tilt in the sliding portion 373*a*.

Figure 10A:
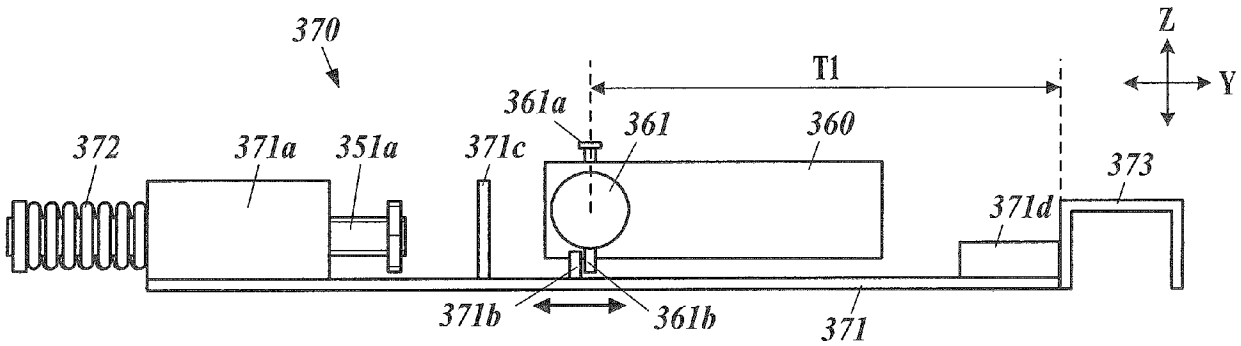
FIG. 10A is a schematic view illustrating variations in rotation angle of the locking member in the locking mechanism, the member being in the state shown in FIGS. 6 to 8.
Figure 10B:
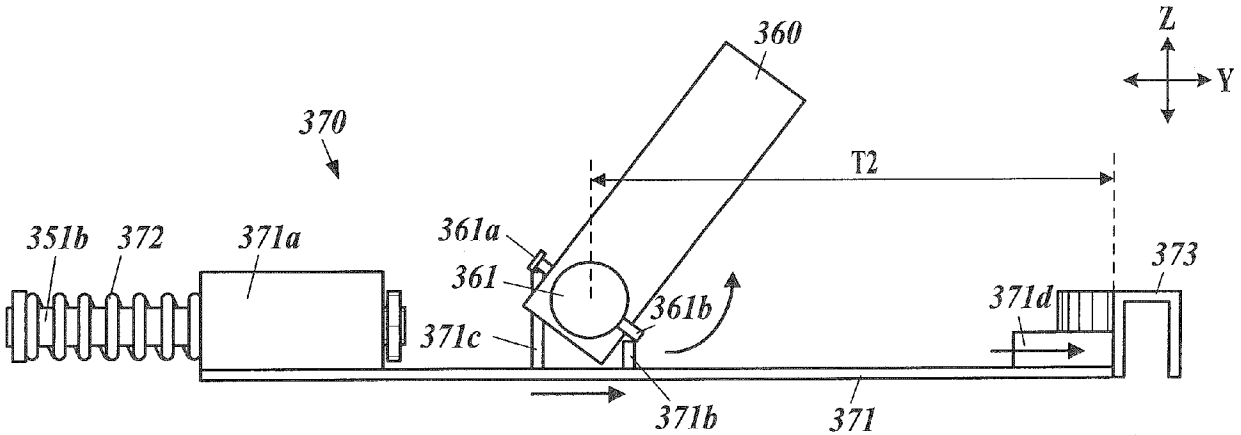
FIG. 10B is a schematic view illustrating variations in rotation angle of the locking member in the locking mechanism, the member being in the state shown in FIG. 9.

FIGS. 10A and 10B are schematic views illustrating variations in rotation angle of the locking member 360 in the locking mechanism 370. FIG. 10A is a schematic view illustrating rotation angle of the locking member 360 in the state shown in FIGS. 6 to 8. FIG. 10B is a schematic view illustrating rotation angle of the locking member 360 in the state shown in FIG. 9.

When the transmission member 373 moves in the X-direction, the contact point between the transmission member 373 and the movable unit 371 moves along the tilt in the sliding portion 373*a*. If the transmission member 373 moves along the X-direction, the tilt in the sliding portion 373*a* changes the length of a line parallel to the Y-direction extending from the contact point between the sliding portion 373*a* and the end 371*d* to the shaft 361. Specifically, when the sliding portion 373*a* and the end 371*d* are in contact with each other at a point closer to the edge of the tapered end of the transmission member 373 (see FIG. 10B), the resulting distance T2 is larger than the distance T1 obtained when the sliding portion 373*a* and the end 371*d* are in contact with each other on a line parallel to the X-direction at a point closer to the center of the transmission member 373 (see FIG. 10A).

When the sliding portion 373*a* and the end 371*d* come into contact with each other on a line parallel to the X-direction at a point closer to the center of the transmission member 373, as shown in FIG. 10A, the contact member 371*b* standing on the base of the movable unit 371 along the X-Y plane is distanced from a projection 361*b* being on a line parallel to the Y-direction on which the contact member 371*b* also exists and extending downward from the lower side of the shaft 361. The engaging member 371*c* standing on the base of the movable unit 371 along the X-Y plane in a different position from the contact member 371*b* is distanced from the pin 361*a* of the shaft 361. Thus, the movable unit 371 and the shaft 361 are out of contact, and the locking member 360 is laid on the base 351 by the pressure by the biasing member 362.

When the transmission member 373 in the state as shown in FIG. 10A moves such that the sliding portion 373*a* and the end 371*d* come into contact with each other in the tapered portion, as shown in FIG. 10B, the movable unit 371 moves toward the first side by the pressure by the biasing member 372. The pressure by the biasing member 372 is given to the movable unit 371 even in the state shown in FIG. 10A. This means that the biasing member 372 biases the movable unit 371 by pushing the movable unit 371 against the transmission member 373, and the movable unit 371 moves as the contact point between the movable unit 371 and the transmission member 373 moves in the Y-direction.

When the transmission member 373 in the state as shown in FIG. 10A moves toward the first side and thus moves the movable unit 371 to the position shown in FIG. 10B, the contact member 371*b* comes into contact with the projection 361*b* and biases the projection 361*b* to the first side. The biasing rotates the shaft 361, so that the second end of the locking member 360 stands up from the base 351 of the cutter 350. The engaging member 371*c* keeps the rotation angle of the shaft 361 to keep a predetermined standing angle of the second end of the locking member 360 on the base 351 of the cutter 350, in combination with the pin 361*a* of the shaft 361.

The biasing member 372 biases the movable unit 371 with such a pressure that the pressure resulting from the contact of the contact member 371*b* with the projection 361*b* to rotate the shaft 361 becomes higher than the pressure given by the biasing member 362 to the locking member 360 toward the base 351 of the cutter 350. Thus, the rotation angle of the locking member 360 varies according the position of the movable unit 371.

The relation among the motion of the cutter 350, the motion of the locking member 360 of the locking unit 370, and locking of the door 302 will now be described.

The cutter 350 includes a holder 352 moving toward or away from a predetermined position to pinch and hold a sheet, and a cutter blade 353 moving toward or away from the sheet held by the holder 352 at the predetermined position to cut the sheet.

Figure 11:
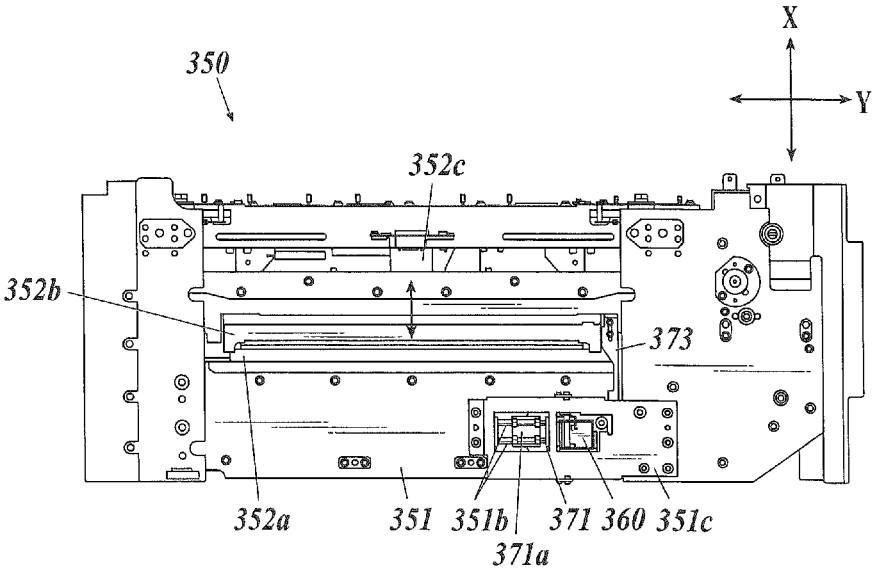
FIG. 11 is a top view of the cutter with holder closed.
Figure 12:
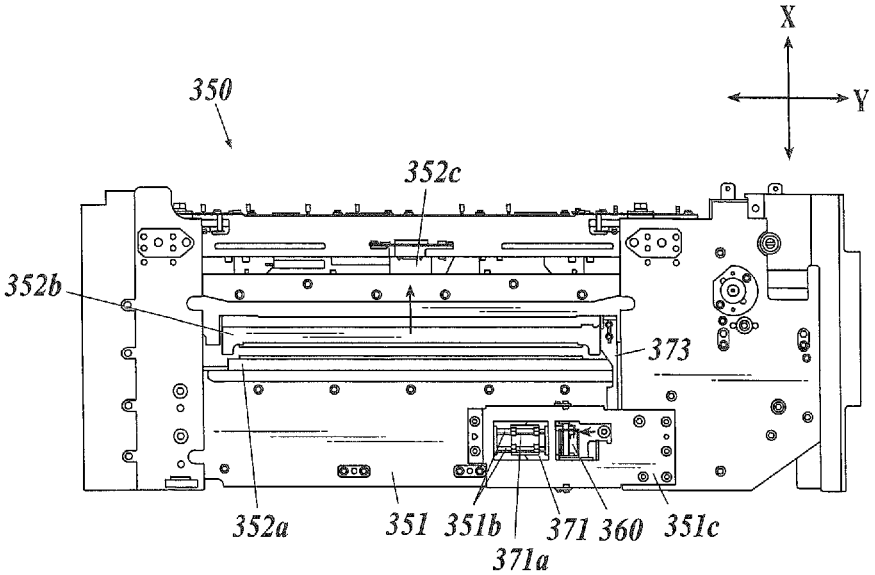
FIG. 12 is a top view of the cutter with holder opened.

FIGS. 11 and 12 are top views of the cutter 350. FIG. 11 illustrates the cutter with holder 352 closed. FIG. 12 illustrates the cutter with holder 352 opened.

Figure 13:
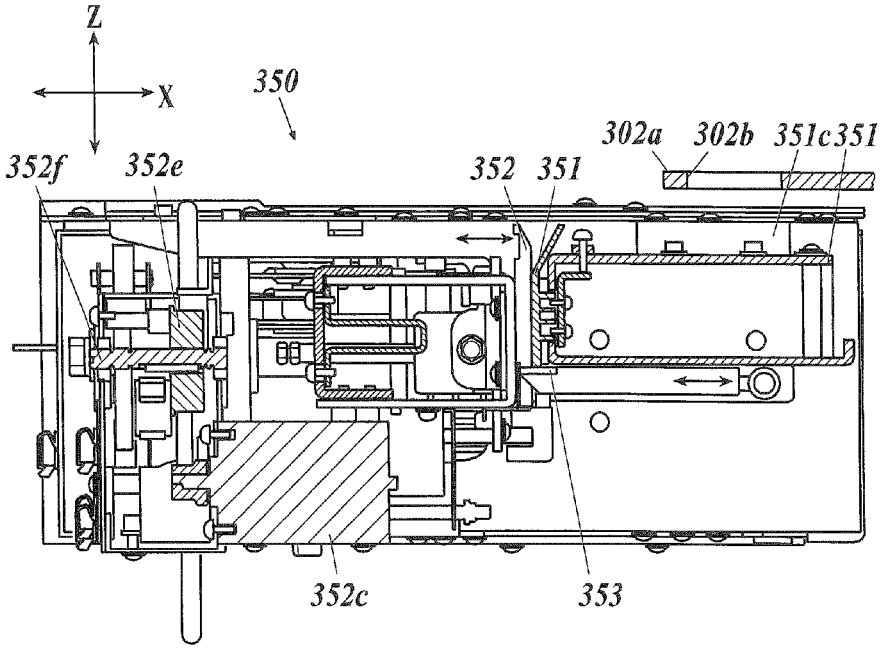
FIG. 13 is a plane cross-sectional view of the cutter along the line X-Z in the state shown in the top view of FIG. 11.
Figure 14:
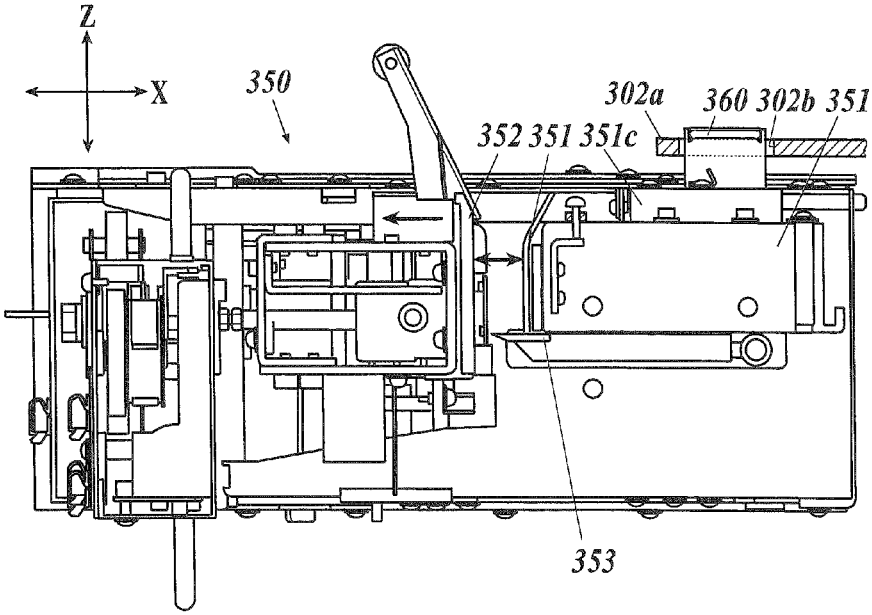
FIG. 14 is a plane cross-sectional view of the cutter along the line X-Z in the state shown in the top view of FIG. 12.

FIGS. 13 and 14 are cross-sectional plan views of the cutter 350 along line X-Z in the states shown in the top views of FIGS. 11 and 12, respectively. The holder 352 includes a fixed member 352*a* and a movable member 352*b* facing each other in the X-direction and pinching a sheet in combination, and a driving unit 352*c* moving the movable member 352*b* in the X-direction.

As shown in FIGS. 11 to 14, the fixed member 352*a* and the movable member 352*b* have flat faces facing each other along the Y-Z plane. The fixed member 352*a* is fixed such that its flat face is parallel to the base 351 of the cutter 350. The movable member 352*b*, which is movable toward the fixed member 352*a* in the X-direction, moves such that its flat face approaches to the fixed member 352*a* to pinch a sheet together with the flat face of the fixed member 352*a*.

Figure 15:
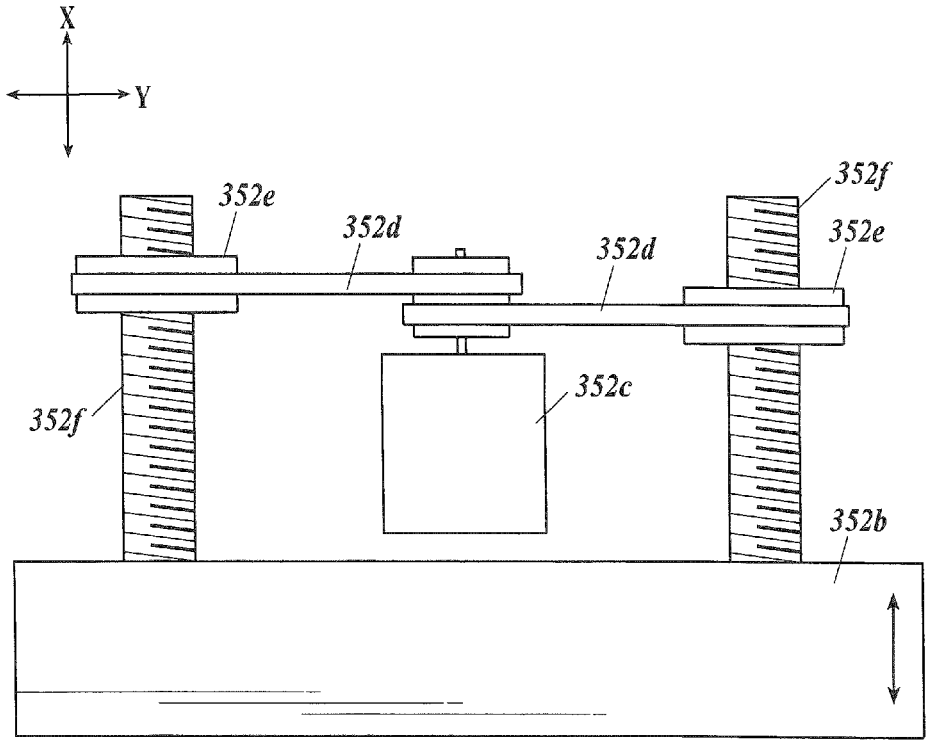
FIG. 15 is a schematic view illustrating an example connection of a movable unit and a driving unit.

FIG. 15 is a schematic view illustrating an example connection of the movable member 352*b* and the driving unit 352*c*.

The driving unit 352*c* is a motor such as an electric motor, and rotates under control by a sheet processing controlling unit 505 described later. As shown in FIG. 15, the driving unit 352*c* turns nuts 352*e* via transmitting belts 352*d*. The turned nuts 352*e* move bolts 352*f* in the X-direction, the bolts 352*f* being engaged in the nuts though their helical structures. Each bolt 352*f* having one end fixed to the movable member 352*b* transmits the force in the X-direction resulting from the turning of the corresponding nut 352*e* to the movable member 352*b*.

The cutter blade 353 is provided separately from the holder 352 and movable in the X-direction. The blade is moved in the X-direction by a driving unit such as an air cylinder, not shown in the drawing, comes into contact with the sheet held by the holder 352, and trims the bottom edge of the sheet.

As shown in FIGS. 11 and 12, the transmission member 373 is fixed to one end, in the Y-direction on the first side, of the movable member 352*b*. This indicates that the transmission member 373 moves in the X-direction with the movement of the movable member 352*b* in the X-direction which occurs when the holder 352 holds and releases a sheet. Such movement of the transmission member allows the sliding portion 373*a* of the transmission member 373 to slide on the end 371*d* of the movable member 371, thereby shifting the contact point between the sliding portion 373*a* and the end 371*d* in the Y-direction. The shift of the contact point allows the movable member 371 to move in the Y-direction and thus the rotation angle of the locking member 360 to change.

When the locking member 360 has such a rotation angle that the second end stands up from the base 351 of the cutter 350 as shown in FIGS. 9, 10B, 14, the second end is inserted into the engaging hole 302*b* in the engaging member 302*a* integrated with the door 302 as shown in FIG. 14. In this situation where the locking member 360 is in the engaging hole 302*b* to lock the door 302, the door 302 cannot be opened, keeping the opening 300*a* covered.

In contrast, when the second end of the locking member 360 is not standing as shown in FIGS. 6 to 8, FIG. 10A, FIG. 13, the second end is under and out of the engaging hole 302*b*, keeping the door unlocked. In this situation, the door 302 is not locked by the locking member 360 and can be opened and closed by the user and any other person.

Thus, the locking member 360, which mechanically connects the movable member 352*b* to the locking member 360, locks and unlocks the door 302 depending on the position of the movable member 352*b* relative to the predetermined position.

Specifically, the locking member 360 rotates about the shaft 361 to enter or exit the engaging hole 302*b* of the door 302. The locking mechanism 370 in cooperation with the cutter 350, locks and unlocks the door 302 depending on the position of the movable member 352*b* relative to the fixed member 352*a*, using the locking member 360. Specifically, the locking mechanism 370 transmits the linear movement of the movable member 352*b* through the transmission member 373 such that a position along a predetermined direction (e.g., the X-direction) of the movable unit 371 biased to the first side by the biasing member 372 in the predetermined direction corresponds to a predetermined position of the movable member 352*b*. The position of the movable unit 371 moving in the predetermined direction determines the contact between the movable unit 371 and the projection 361*b* of the shaft 361. Upon contact between the movable unit 371 and the projection 361*b* of the shaft 361, the locking mechanism. 370 inserts the locking member 360 into the engaging hole 302*b*, the locking member 360 being rotatable about the shaft 361 and biased by the biasing member 362 in a direction releasing the insertion into the engaging hole 302*b*.

The locking mechanism 370 is configured to push up the locking member 360 and lock the door 302 when the distance from the movable member 352*b* to the fixed member 352*a* is a predetermined value or higher, and to raise the locking member 360 on the base 351 and unlock the door 302 when the distance from the movable member 352*b* to the fixed member 352*a* is below the predetermined value. These operations are achieved by the transmission member 373 and the movable unit 371 which move with the movable member 352*b*.

Specifically, the predetermined distance is set to such a value that a human hand can be inserted into a space between the movable member 352*b* and the fixed member 352*a* (e.g., 1 cm). Hence, while the door 302 is unlocked by the locking member 360, the space is narrowed to an area that inhibits insertion of a human hand. In other words, while the door 302 is opened and the cutter 350 is accessible, the user is prevented from accidentally inserting his hand into the space between the movable member 352*b* and the fixed member 352*a*.

Figure 16:
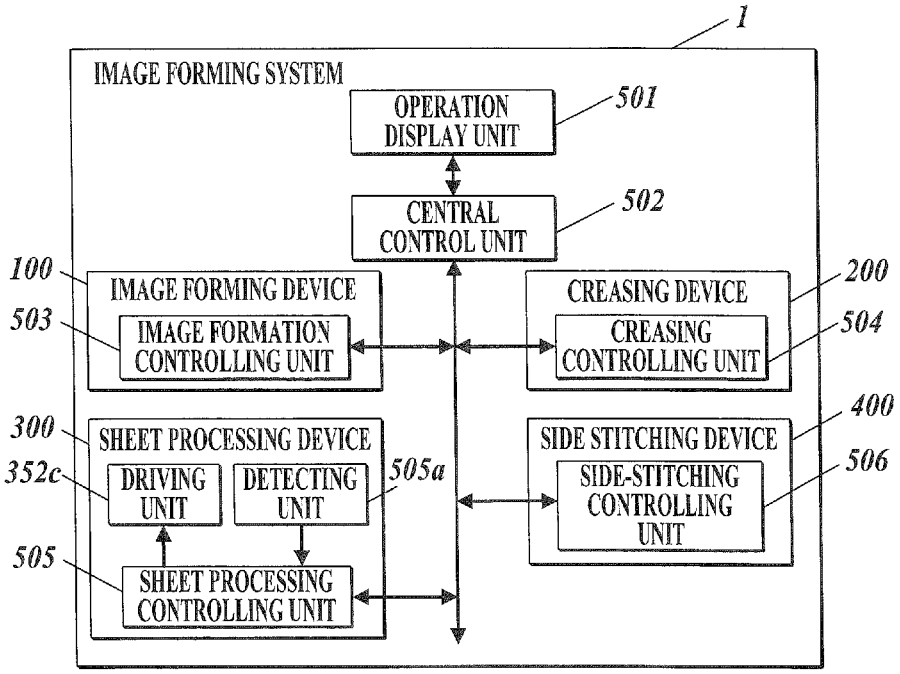
FIG. 16 is a block diagram illustrating a structure to control the image forming system.

FIG. 16 is a block diagram illustrating a structure to control the image forming system 1.

The image forming system 1 includes an operation display 501 being a medium through which the user operates the image forming system 1 and displaying information on the operation of the image forming system 1; a central control unit 502 controlling the operation of the overall image forming system 1; an image formation controlling unit 503 controlling the operation of the image forming device 100; a creasing controlling unit 504 controlling the operation of the creasing device 200; a sheet processing controlling unit 505 controlling the operation of the sheet processing device 300; and a side-stitching controlling unit 506 controlling the operation of the side stitching device 400.

The operation display 501 has a touch-screen, input switches, input keys, and other parts, and sends a signal based on the input by the user to the central control unit 502.

The central control unit 502, the image formation controlling unit 503, the creasing controlling unit 504, the sheet processing controlling unit 505, and the side-stitching controlling unit 506 each include a CPU, RAM, ROM, and other units, and run or read a software program or data appropriate for the processing.

The central control unit 502 changes relevant parameters on the image forming system. 1 according to the input by the user through the operation display 501. The parameters are the size of a sheet, the number of colors for image formation (e.g., color, grayscale, monochrome), selection of creasing and/or trimming, the number of sheets for a saddle-stitched book. The central control unit 502 then instructs the image formation controlling unit 503, the creasing controlling unit 504, the sheet processing controlling unit 505, and the side-stitching controlling unit 506 to perform a process according to the parameters. Each controlling unit controls the operation of the corresponding device according to the instruction.

The operation of the sheet processing controlling unit 505 will now be described.

When a detecting unit 505*a* in the sheet processing device 300 detects sheet jam, the sheet processing controlling unit 505 operates the cutter 350 such that the locking member 360 unlocks the door 302. The details will be described below.

The detecting unit 505*a* includes an optical sensor on a path for transmitting sheets in the sheet processing device 300. The detecting unit 505*a* determines the pass of a sheet at a point on the path at a predetermined timing as a result of the operations of the units in the sheet processing device 300 controlled by the sheet processing controlling unit 505, on the basis of shading of light from the optical sensor by the sheet moving on the path.

If the optical sensor does not detect a sheet passing through the point on the path at the predetermined timing, the detecting unit 505*a* sends a signal for indicating the detection of sheet jam to the sheet processing controlling unit 505. Receiving the signal from the detecting unit 505*a*, the sheet processing controlling unit 505 operates the driving unit 352*c* in the cutter 350 to adjust the distance between the movable member 352*b* and the fixed member 352*a* below the predetermined value. Consequently, the locking member 360 is laid on the base 351, so that the locking member 360 unlocks the door 302. Thus, the user or mechanic can open the door 302 to access the inside of the sheet processing device 300 and remove the sheet causing the jam. Since the distance between the movable unit 352*b* and the fixed member 352*a* is below the predetermined value, the user and any other person accessing the inside of the sheet processing device 300 to solve the sheet jam is prevented from accidentally inserting their hands into the space between the movable member 352*b* and the fixed member 352*a*.

The sheet processing device 300 further includes an unlocking member to manually unlock the door 302 locked by the locking member 360.

The unlocking member in the sheet processing device 300 corresponds to the through hole 380 in the door 302 in FIGS. 2 and 3. The through hole 380 is a slit extending through the closed door 302 in the Y-direction. The through hole 380 is located at substantially the same height in the vertical direction (the Z-direction) as the second end of the locking member 360 laid on the base 351 of the cutter 350. The through hole 380 has a width in the Z-direction that enables a plate member P (e.g., the tip of a slotted screwdriver) to enter the hole. The through hole 380 also has a width in the Y-direction that enables the second end to be moved by rotation of the locking member 360 and that enables the plate member P to be inserted thereinto, on a side to which the second end is moved by the rotation of the locking member 360 standing up from the base 351 (the left side in FIGS. 17A and 17B).

Figure 17A:
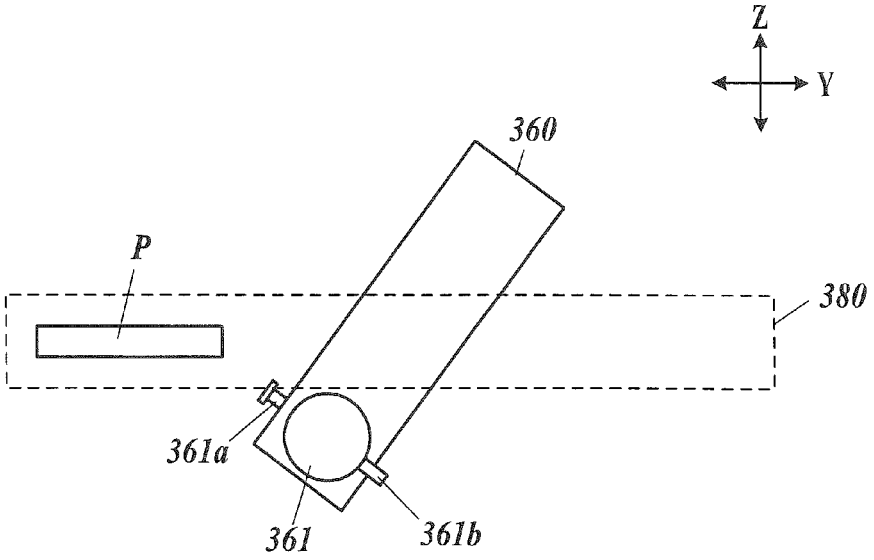
FIG. 17A illustrates an example of a manual operation to unlock the door locked by the locking member via a through hole, where a plate member is inserted to a first side of the through hole.
Figure 17B:
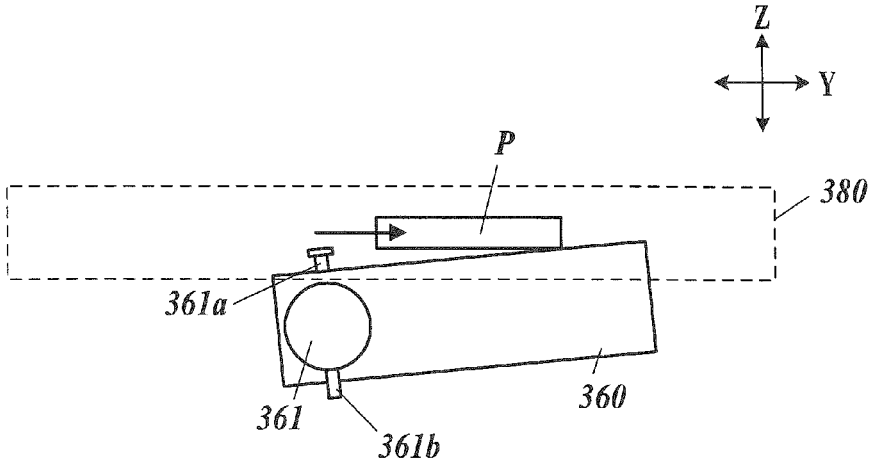
FIG. 17B illustrates an example of a manual operation to unlock the door locked by the locking member via a through hole, where the plate member is moved toward a second side of the through hole.

FIGS. 17A and 17B illustrate a manual operation to unlock the door 302 locked by the locking member 360 via the through hole 380.

The user or mechanic can unlock the door 302 locked by the locking member 360 from the through hole 380 by inserting the plate member P into one side portion (the left side in FIG. 17A) of the through hole 380 and moving the plate member P to the other side portion (the right side in FIG. 17B) in the longitudinal direction of the through hole 380 to bring the plate member P into contact with the locking member 360. Thus, the locking member 360 is manually rotated and laid on the base 351. Consequently, the second end of the locking member 360 is shifted downward from the engaging hole 302*b*, releasing the door 302 from the locking member 360.

As described above, the image forming system 1 in this embodiment includes the locking mechanism 370 that mechanically operates in cooperation with the cutter 350 to lock and unlock the door 302 by the locking member 360 depending on the position of the movable member 352*b* relative to the predetermined position. Thus, the door 302 can be locked by the locking member 360 in a simple structure, and the conditions to access the inside of the sheet processing device 300 are limited to ensure the safety of the user and any other person.

The locking mechanism 370 causes the locking member 360 to lock the door 302 when the distance between the movable member 352*b* and the predetermined position is a predetermined value or larger, and to unlock the door 302 when the distance between the movable member 352*b* and the predetermined position is below the predetermined value. Hence, while the door 302 is unlocked by the locking member 360, the space between the movable unit 352*b* and the fixed member 352*a* is narrowed to an area that inhibits insertion of a human hand. In other words, while the door 302 is opened and the cutter 350 is accessible, the user is prevented from accidentally inserting his hand into the space between the movable member 352*b* and the fixed member 352*a*. This ensures the safety of the user and any other person accessing the inside of the sheet processing device 300. While the space between the movable member 352*b* and the fixed member 352*a* is wide to insert a human hand, the locking member 360 locks the door 302. Thus, the conditions to access the inside of the sheet processing device 300 are limited to ensure the safety of the user and any other person.

The cutter 350 includes the holder 352 that pinches and holds a sheet by moving the movable member 352*b* toward or away from the fixed member 352*a* of which the flat surface portion for pinching the sheet is disposed at a predetermined position. The locking mechanism 370 locks and unlocks the door 302 by the locking member 360 depending on the motion of the holder 352. As a result, the space between the movable member 352*b* and the fixed member 352*a* is narrowed to an area that inhibits insertion of a human hand. Consequently, while the door 302 is opened and the cutter 350 is accessible, the user is prevented, for example, from accidentally inserting his hand into the space between the movable member 352*b* and the fixed member 352*a* and getting his hand pinched in the holder 352. This leads to the safety of the user and any other person accessing the inside of the sheet processing device 300. The system further includes the detecting unit 505*a* that is disposed in the sheet processing device 300 and detects sheet jam; and the sheet processing controlling unit 505 that operates the cutter 350 in the case of detection of sheet jam by the detecting unit 505*a* such that the locking member 360 unlocks the door 302. In case of sheet jam, the locking member 360 unlocks the door 302 to provide easy access to the inside of the sheet processing device 300, which helps to readily solve the sheet jam.

The system further includes the through hole 380 through which the operation from the exterior of the sheet processing device 300 forces the locking member 360 to unlock the door 302. The user and any other person can therefore open the door 302 any time and thus can manually release the door 302 from the locking member 360 when necessary. It should be understood that the embodiments of the present invention are to be taken as illustrative only and do not limit the scope of the invention. The scope of the present invention should be defined not by the description of the embodiment but by the claims. Equivalents and all modifications of the claims should be included in the scope of the present invention.

In the above embodiment, for example, the movable member 352*b* of the holder 352 acts in collaboration with the locking mechanism 370 in the cutter 350. This is however just one example and not indispensable. For example, the locking mechanism 370 may operate such that the cutter blade 353 mechanically works with the locking member 360 and the locking member 360 locks or unlocks the door 302 depending on the position of the cutter blade 353 relative to a sheet in the predetermined position. In other words, the movable member 352*b*, which functions as a sheet holder with the fixed member 352*a* as described in the above embodiment, may have a cutter blade moving toward the predetermined position in response to the motion of the movable unit.

In the above embodiment, one of the members to hold a sheet, the movable member 352*b*, moves toward the other member, the fixed member 352*a*. Alternatively, the both members may move toward or away from the predetermined position where the sheet is held.

The way of locking the door 302 by the locking member 360 according to the above embodiment is just one example and is not indispensable.

Figure 18A:
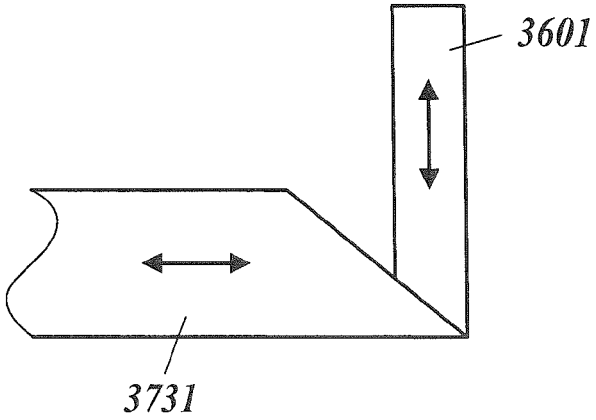
FIG. 18A is a diagram of an example of a locking member and a locking mechanism.
Figure 18B:
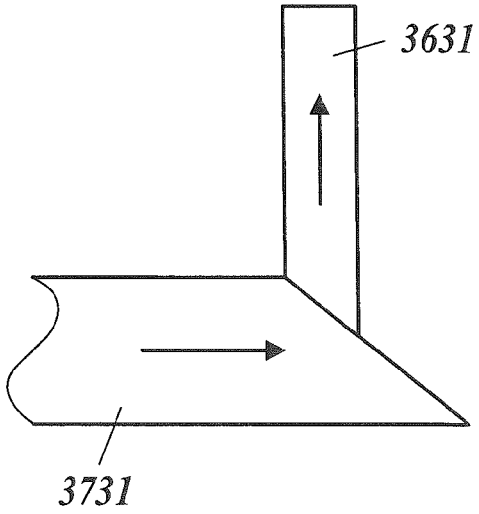
FIG. 18B is a diagram of an example of a locking member and a locking mechanism.
Figure 19:
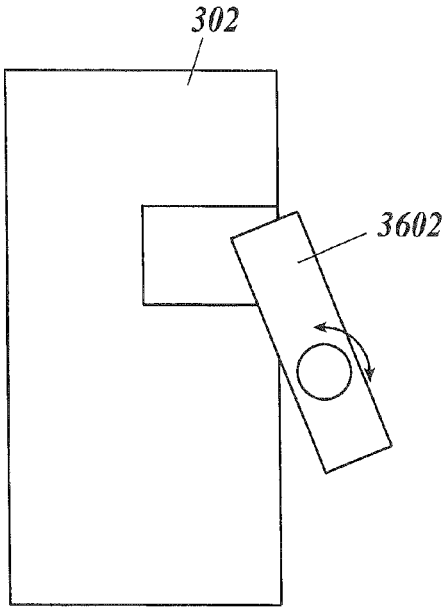
FIG. 19 is a diagram of a locking member and a locking mechanism different from those in FIGS. 18A and 18B.
Figure 20:
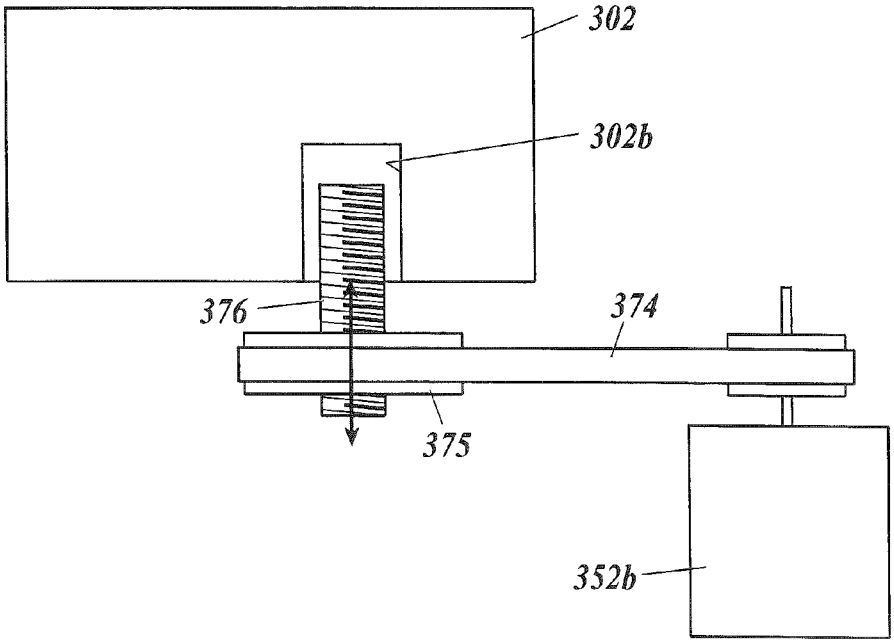
FIG. 20 is a diagram of a locking member and a locking mechanism different from those in FIGS. 18A, 18B, and 19.

FIGS. 18 to 20 illustrate another locking member and another locking mechanism.

For example, as shown in FIGS. 18A and 18B, an inclined surface of a transmission member 3731 may be brought into direct contact with a locking member 3601 such that the locking member 3601 is linearly moved by the inclined surface. In FIGS. 18A and 18B, the inclined surface of the transmission member 3731 slides under the locking member 3601 to lift or lower the locking member 3601. The positional relationship between the transmission member 3731 and the locking member 3601 can however be changed as appropriate. An additional member to move the locking member 3601 may be provided between the transmission member 3731 and the locking member 3601.

As shown in FIG. 19, the door 302 may be locked with a rotating locking member 3602 partially stuck in the door 302.

As shown in FIG. 20, a bolt 376 may be provided to enter the engaging hole 302*b* in the door 302. The bolt is moved by power transmitted from the driving unit 352*c*, which moves the movable member 352*b*, through a transmission belt 374 or nut 375. This structure can also move the movable member 352*b* and mechanically lock the door 302 by the same power.

Any other unlocking member may be used in place of the through hole 380 described in the above embodiment. For example, the unlocking member may include an externally operable lever at a position corresponding to the through hole 380 and a member linearly moving or rotating to topple the locking member 360 in response to the motion of the lever instead of the plate member P. The detecting unit 505*a*, the sheet processing controlling unit 505, and other units are also just one example and not indispensable. For example, instead of separately providing the central control unit 502 and the sheet processing controlling unit 505 as described in the above embodiment, one collective controlling unit having the combined functions of these units may be provided. The collective controlling unit may combine the functions of the other controlling units in the image forming system 1.

The detecting unit 505*a* is not limited to an optical unit and may be any type of unit that can detect the pass of a sheet. For example, the detecting unit 505*a* may detect the pass of a sheet by physical contact with the sheet passing the transmission path.

In the above embodiment, the cutter 350 cuts a plurality of saddle-stitched sheets, but this is just one example and not indispensable. For example, the cutter 350 may hold and cut a single sheet or a plurality of sheets that are not saddle-stitched. The components of the image forming system 1 are just one example, and can be changed as appropriate without departing from the scope of the present invention.

For example, the image forming device 100, the creasing device 200, the sheet processing device 300, and the side stitching device 400 in the image forming system 1 may be partly or completely integrated. The devices in the image forming system 1 may be partly omitted.

This U.S. patent application claims priority to Japanese patent application No. 2012-083449 filed on Apr. 2, 2012, the entire contents of which are incorporated by reference herein for correction of incorrect translation.

What is claimed is:

1. A sheet processing device for use with a sheet, the sheet processing device comprising:

a cutter comprising a movable unit which moves between a first position close to a predetermined position and a second position away from the predetermined position and cuts a sheet held at the predetermined position;

a door provided to a housing having an opening, the door opening and closing the opening provided for maintenance for the cutter, the housing holding the cutter;

a locking member which locks and unlocks the door closing the opening; and a locking mechanism which mechanically connects the movable unit to the locking member, wherein the locking mechanism locks the door when the movable unit is located at the second position and the locking mechanism unlocks the door when the movable unit is located at the first position.

2. The sheet processing device of claim 1, further comprising an unlocking member to release the door from the locking member by an operation from an exterior of the sheet processing device.

3. A sheet processing device comprising:

a cutter including a movable unit which moves toward or away from a predetermined position and cuts a sheet held at the predetermined position;

a door provided to a housing having an opening, the door opening and closing the opening provided for a maintenance for the cutter, the housing holding the cutter;

a locking member which locks and unlocks the door closing the opening; and a locking mechanism which mechanically connects the movable unit to the locking member and causes the locking member to lock the door if a distance from the movable unit to the predetermined position is a predetermined value or greater and to unlock the door if the distance from the movable unit to the predetermined position is below the predetermined value.

4. A sheet processing device comprising:

a cutter comprising a movable unit which moves toward or away from a predetermined position and cuts a sheet held at the predetermined position, wherein the movable unit includes a holder including two pinch members facing each other, the holder moving at least one of the pinch members toward or away from the predetermined position to pinch and hold a sheet between the pinch members;

a door provided to a housing having an opening, the door opening and closing the opening provided for a maintenance for the cutter, the housing holding the cutter; and a locking mechanism which mechanically connects the movable unit to the locking member and causes the locking member to lock or unlock the door depending on a position of the movable unit relative to the predetermined position.

5. The sheet processing device of claim 4, wherein the movable unit includes a cutter blade which moves toward or away from the sheet held in the predetermined position by the holder and cuts the sheet.

6. A sheet processing device comprising:

a cutter including movable unit which moves toward or away from a predetermined position and cuts a sheet held at the predetermined position;

a door provided to a housing having an opening, the door opening and closing the opening provided for a maintenance for the cutter, the housing holding the cutter;

a locking mechanism which mechanically connects the movable unit to the locking member and causes the locking member to lock or unlock the door depending on a position of the movable unit relative to the predetermined position;

a detecting unit which detects sheet jam in the sheet processing device; and a controlling unit which drives the movable unit to release the door from the locking member in response to detection of sheet jam by the detecting unit.

7. An image forming system comprising:

an image forming device forming an image on a sheet; and an sheet processing device wherein the sheet on which the image formed by the image forming device is cut, the sheet processing device comprising:

a cutter comprising a movable unit which moves between a first position close to a predetermined position and a second position away from the predetermined position and cuts a sheet held at the predetermined position;

a door provided to a housing having an opening, the door opening and closing the opening provided for maintenance for the cutter, the housing holding the cutter;

a locking member which locks and unlocks the door closing the opening; and a locking mechanism which mechanically connects the movable unit to the locking member, wherein the locking mechanism locks the door when the movable unit is located at the second position and the locking mechanism unlocks the door when the movable unit is located at the first position.

* * * * *